US005875889A

United States Patent [19]

Albisetti

[11] Patent Number: 5,875,889

[45] Date of Patent: Mar. 2, 1999

[54] DEVICE FOR SEPARATELY PACKAGING TWO COMPONENTS, FOR MIXING THEM TOGETHER AND FOR DISPENSING THE RESULTING MIXTURE

[75] Inventor: Nicolas Albisetti, Clichy, France

[73] Assignee: L'Oreal, Paris, France

[21] Appl. No.: 897,671

[22] Filed: Jul. 21, 1997

[30] Foreign Application Priority Data

Aug. 2, 1996 [FR] France ..... 96 09820

[51] Int. Cl.[6] ..... B65D 25/08

[52] U.S. Cl. ..... 206/221; 206/568; 215/DIG. 8; 222/129; 222/145.5

[58] Field of Search ..... 206/219, 221, 206/568; 222/94, 129, 145.5, 207, 529; 215/DIG. 8

[56] References Cited

U.S. PATENT DOCUMENTS

| | | | |
|---|---|---|---|
| 3,856,138 | 12/1974 | Maekawa et al. | 206/221 |
| 4,936,446 | 6/1990 | Lataix . | |
| 5,088,627 | 2/1992 | Musel | 222/145.5 |
| 5,277,303 | 1/1994 | Goyet et al. | 206/221 |
| 5,417,321 | 5/1995 | Halm | 206/221 |
| 5,613,623 | 3/1997 | Hildebrandt | 222/129 |

FOREIGN PATENT DOCUMENTS

| | | |
|---|---|---|
| 0-588-667-A | 3/1994 | European Pat. Off. . |
| 1-509-145-A | 11/1966 | France . |
| 2-506-726-A | 12/1982 | France . |
| 2-599-006-A | 11/1987 | France . |
| 2-687-567-A | 8/1993 | France . |
| 2-729-372-A | 7/1996 | France . |
| 40-06-193-A | 8/1991 | Germany . |

*Primary Examiner*—Bryon P. Gehman
*Attorney, Agent, or Firm*—Oliff & Berridge, PLC

[57] ABSTRACT

A device for separately packaging two components, for mixing them together, and for dispensing the resulting mixture, includes a receptacle having two compartments, a removable plug for separating the compartments prior to first use, a dispenser endpiece, a rotary drive member suitable, in an initial position, for preventing the endpiece being opened, and a coupling device for transforming rotation of the drive member into action on the plug for the purpose of putting the two compartments into communication with each other. The coupling device includes a coupling member that is axially movable relative both to the receptacle and to the drive member.

20 Claims, 4 Drawing Sheets

DEVICE FOR SEPARATELY PACKAGING TWO COMPONENTS, FOR MIXING THEM TOGETHER AND FOR DISPENSING THE RESULTING MIXTURE

The present invention relates to a device for separately packaging two components, for mixing them together, and for dispensing the resulting mixture.

BACKGROUND OF THE INVENTION

Numerous devices are already known for separately storing two components which are to be mixed together extemporaneously on first use.

U.S. Pat. No. 4,936,446 discloses a device comprising a receptacle formed by assembling together a bellows and a flask having a neck. The bottom end of the bellows is snapped onto the neck of the flask, and its other end is provided with a dispensing endpiece. The neck of the flask is closed by a removable plug, and the flask and the bellows can thus separately contain two separate components for mixing together on first use of the device. The dispensing endpiece is screwed into a tapped orifice of a rotary drive member engaged on the neck of the flask and designed to exert force on the plug to put the two compartments into communication with each other on first use of the device. A closure cap is screwed onto the dispenser endpiece to close it. The drive member is shaped so as to prevent the user gripping the closure cap until the drive member has been rotated to displace the plug and put the flask into communication with the bellows. Displacement of the plug is accompanied by the bellows lengthening and by the closure cap emerging from the drive member, thereby making it possible to open the dispenser endpiece. Such a device is relatively complex and expensive to make. In particular, the bellows can be difficult to make, specifically if it is designed to contain a component whose nature restricts the materials that can be used for making the bellows, or indeed the manufacturing techniques that can be implemented.

OBJECTS AND SUMMARY OF THE INVENTION

An object of the invention is to propose a novel device for separately packaging two components, for mixing them together, and for dispensing the resulting mixture, which device is relatively easy and cheap to manufacture and is suitable for packaging a component that is an irritant or that is corrosive.

The invention achieves this by providing a device of the type comprising a receptacle having two compartments, a removable plug for separating said compartments prior to first use, a dispenser endpiece, a rotary drive member suitable, in an initial position, for preventing the endpiece being opened, and coupling means for transforming rotation of the drive member into action on the plug for the purpose of putting the two compartments into communication with each other, wherein said coupling means comprise a coupling member that is axially movable relative both to the receptacle and to the drive member.

Thus, because of the invention, it is no longer necessary to make one of the compartments in the form of a bellows that deforms axially during displacement of the plug. Manufacture of the device is simplified, and the range of manufacturing techniques and materials that can be used is enlarged.

In a particular embodiment of the invention, said coupling means comprise a slideway link between the coupling member and one of the receptacle and the drive member.

Advantageously, the coupling member is in the form of a tubular skirt secured to the dispenser endpiece.

Advantageously, said tubular skirt co-operates by screw-engagement relative to the receptacle and by slideway-type engagement relative to the drive member.

In a particular embodiment of the invention, said plug is integrally molded with a drive rod secured to said coupling member.

In a particular embodiment of the invention, said drive member is externally in the from of a cover that snap-fastens onto the body of the receptacle, and that preferably extends into the bottom compartment.

The device is simple to assemble, the plug being put into place inside the receptacle and then the coupling member being applied together with the dispenser endpiece in the form of a single part into which the plug drive rod snap-fastens. The drive member can then be lowered in a simple translation movement onto the coupling member until it snap-fastens on the body of the receptacle.

In a variant, the coupling member and the drive rod are integrally formed as a single piece by molding, are put into place inside the receptacle, and then the dispenser endpiece is snap-fastened onto the drive rod.

Advantageously, said cover snap-fastens on a rim formed at the end of the top compartment of the receptacle, adjacent to said constriction.

Advantageously, the receptacle comprises a body made as a single piece and having a constriction serving as a seat for said plug prior to the components being mixed together.

Preferably, the receptacle body is made by coextrusion blow-molding, preferably by molding a coextruded PE/EVOH/PE material.

Preferably, the receptacle is open at both ends prior to being filled.

The two openings of the receptacle body facilitate manufacture thereof by injection blow-molding or by coextrusion blow-molding, and they also make it possible to control with great accuracy the inside diameter of the constriction through which the compartments communicate. During separate storage of the two components, this constriction is thus easier to close in sealed manner by means of the plug. Also, the sealing can be tested before the compartments are filled, and filling can advantageously be performed via the respective openings in the receptacle body without any risk of one component contaminating the other.

Preferably, the dispenser endpiece is formed by an internally threaded cap.

In a particular embodiment of the invention, the device includes at least one portion in relief placed on the path of the dispenser endpiece so that when said portion in relief is passed resiliently it clicks audibly, thereby informing the user that the dispenser endpiece has finished its stroke.

In a particular embodiment of the invention, the plug has a shoulder shaped to bear axially against the constriction through which the two compartments communicate. Preferably, when the drive member is in its initial position, the drive rod is axially compressed, and it is shaped in such a manner as to be capable of deforming elastically under the effect of such compression. This further improves sealing of the closure of the compartment through which the coupling member extends prior to first use.

BRIEF DESCRIPTION OF THE DRAWINGS

Other characteristics and advantages of the invention appear on reading the following detailed description of non-limiting embodiments of the invention, and on examining the accompanying drawings, in which.

MORE DETAILED DESCRIPTION

Figure 1:
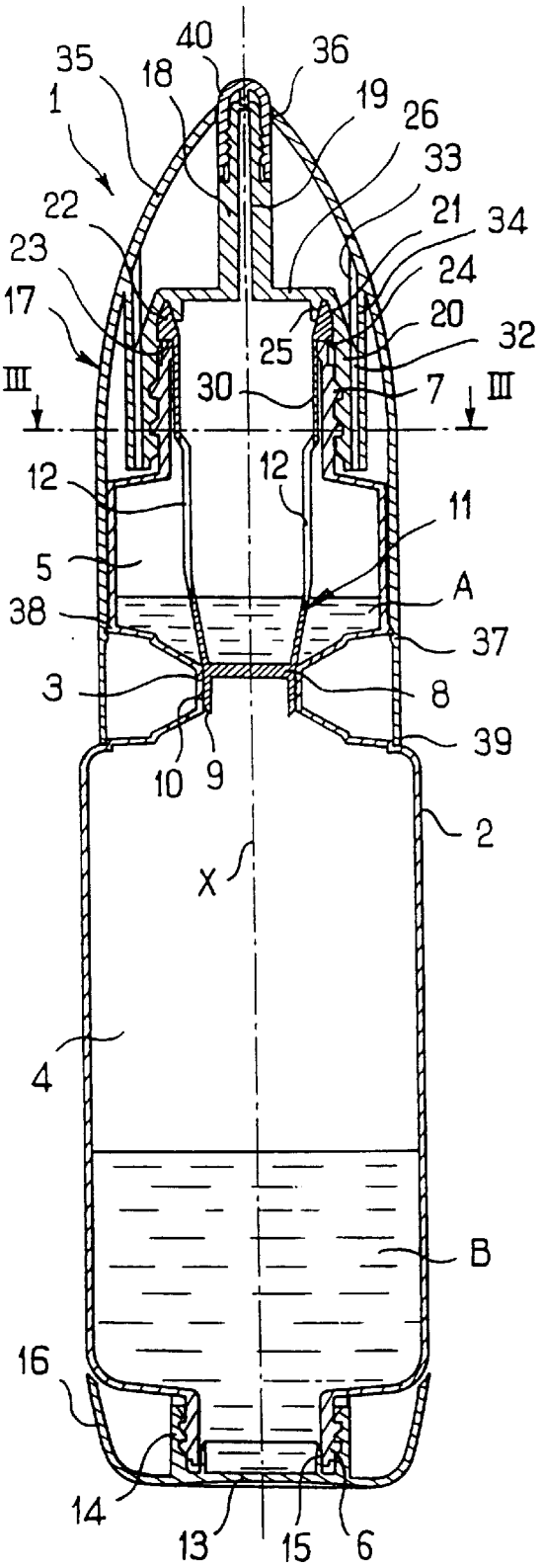
FIG. 1 is a diagrammatic axial section view of a device constituting a first embodiment of the invention, prior to the components being mixed together.
Figure 4:
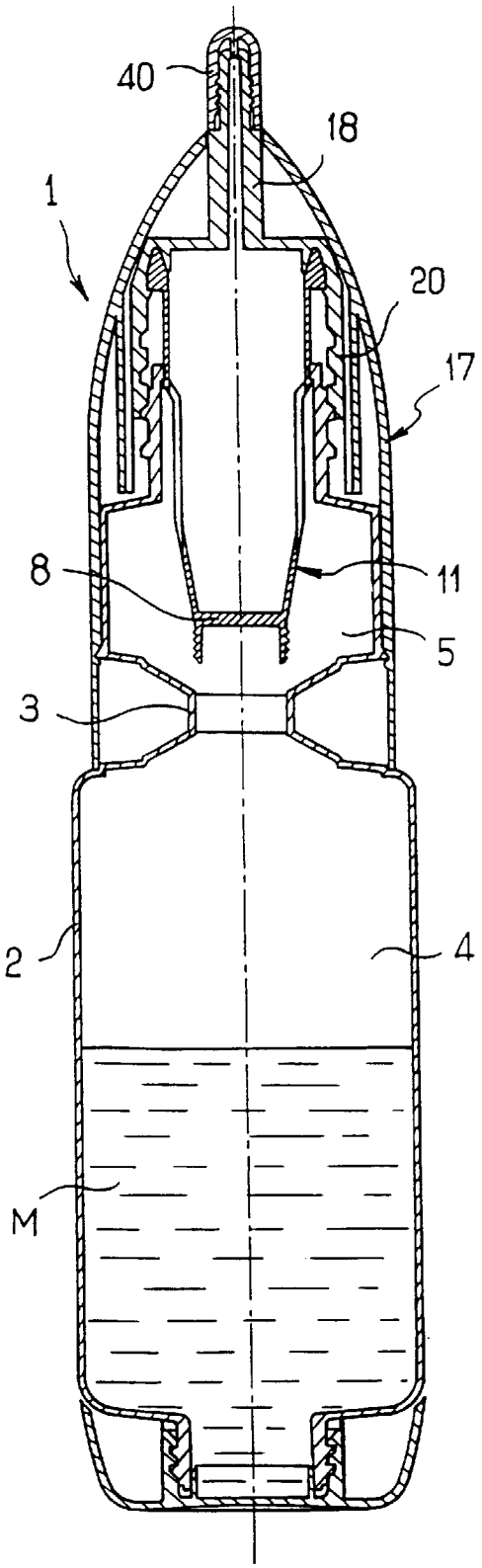
FIG. 4 shows the FIG. 1 device after its components have been mixed together.

FIGS. 1 to 4 show a device 1 constituting a first embodiment of the invention.

The device 1 comprises an elongate receptacle body 2 having a constriction 3 for establishing communication between a bottom compartment 4 and a top compartment 5.

In the embodiment described, the body 2 is generally circularly symmetrical about its longitudinal axis X.

Externally threaded necks 6 and 7 are respectively formed at the bottom and top axial ends of the body 2.

The body 2 is advantageously made by injection blow-molding using a plastics material that is chemically compatible with the components that are to be packaged. As an indication, if one of the components is thioglycolic acid, as is used in hairdressing for making permanent wave preparations, then the body 2 is advantageously made of PVC or is a multilayer structure of PE/EVOH/PE.

The necks 6 and 7 define openings that enable two components A and B that are to be stored separately until first use to be inserted into the body 2. In the particular embodiment described, the components A and B are both liquids.

A plug 8 is placed in the constriction 3 to separate the compartments 4 and 5 until first use, and it includes a sealing lip 9 that fits closely against the radially inner surface 10 of the constriction 3.

The inside diameter of the constriction 3 can be accurately controlled when the body 2 is made by injection blow-molding or by coextrusion blow-molding, thereby making it easier to obtain a sealing fit between the plug 8 and the constriction 3.

It will be observed that because of the relatively simple shape of the body 2, it is relatively easy to control its wall thickness, which is not the case for the bellows of the above-mentioned prior device. It is also difficult to make such bellows out of a multilayer material. The use of a multilayer material makes it possible to combine chemical resistance with mechanical strength while also making it possible to benefit from improved appearance, where appropriate.

The plug 8 is secured to a hollow drive rod 11 having a bottom portion with lateral openings via slots 12 that are angularly distributed around the longitudinal axis X. The drive rod 11 has a circularly cylindrical top portion 30.

After the bottom compartment 4 has been filled with the component B, it is closed by means of an end part 13 having a tubular skirt 14 shaped to screw onto the neck 6, and a sealing lip 15 shaped to fit closely against the inside of the neck 6. At its periphery, the part 13 has a skirt 16 shaped to extend the side wall of the body 2 downwards so as to improve the appearance of the device 1. The skirt 14 includes catches which co-operate with projections formed at the base of the neck 6 so as to prevent the end part 13 being unscrewed by a user.

A drive member 17 is rotatably mounted on the body 2 to enable the user to move the plug 8 so as to mix the components A and B together, in the manner described below.

The resulting mixture M can leave the body 2 via a dispenser endpiece 18 defining an outlet channel 19. The endpiece 18 has its bottom end connected via a transverse wall 26 to a coupling member 20 which is shaped to transform rotation of the drive member 17 into displacement of the plug 8 along the longitudinal axis X.

In the embodiment described, the endpiece 18 and the coupling member 20 are integrally formed with the wall 26 by molding a plastics material and they define an annular groove 21 for snap-fastening to the top end of the drive rod 11 which is thus secured to the coupling member 20.

Figure 2:
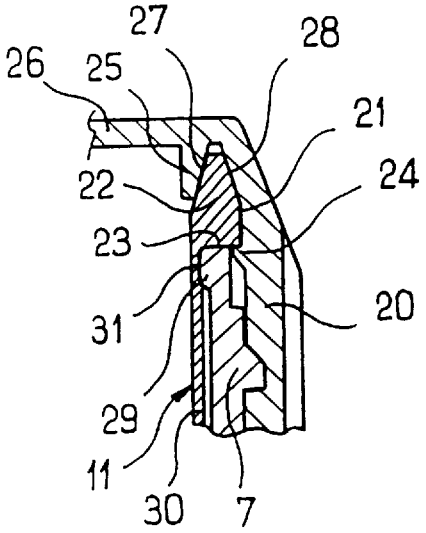
FIG. 2 shows a detail of the FIG. 1 embodiment.
Figure 3:
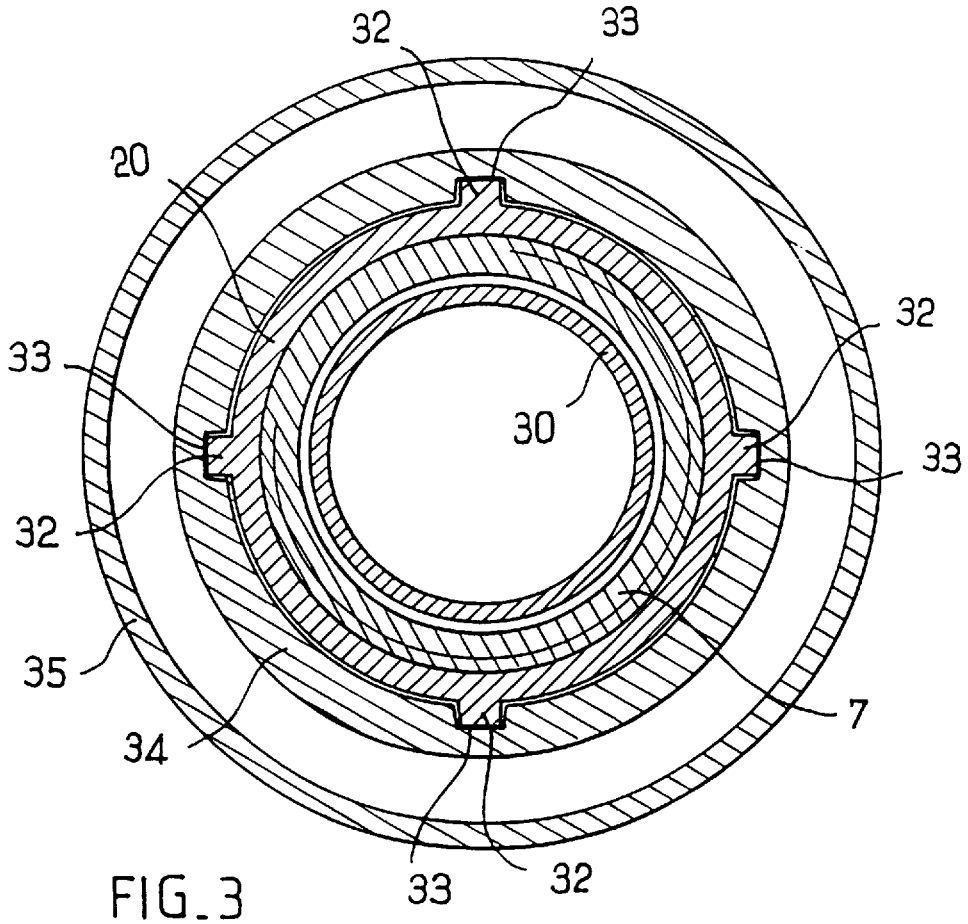
FIG. 3 is a cross-section on section line III—III of FIG. 1.

More particularly, with reference to FIG. 2, the drive rod 11 is provided at its top end with an annular rim 22 defining a shoulder 23 against which there bears a radially inwardly projecting complementary shoulder 24 of the coupling member 20 once the rim 22 has been inserted into the groove 21. The annular rim 22 has a top radially outer surface 21 that tapers upwardly and a radially inner surface 27 that flares upwardly and that fits against an annular sealing rim 25 projecting downwards from the transverse wall 26.

The neck 7 is provided at its top end with an annular rim 29 projecting radially inwards, for bearing in sealed manner against the top portion 30 of the drive rod 11 when the plug 8 is moved upwards. When the plug 8 is in its initial position, the annular rim 29 is received in an annular groove 31 formed in the radially outer surface of the top portion 30 of the drive rod 11.

The coupling member 20 is in the form of a tubular skirt provided on its radially outer surface with axial ribs 32 and on its radially inner surface with threads shaped to engage on the thread of the neck 7. The ribs 32 are engaged in grooves of corresponding shape formed in the radially inner face of the inner tubular skirt 34 of the drive member 17, as shown more particularly in FIG. 3. The skirt 34 is connected to the inside face of a wall of the drive member constituting a cover 35, with the end surface thereof constituting a surface to be gripped by the user. The cover 35 is pierced at its top by an orifice 36 for passing the dispenser endpiece 18, and at its bottom it has a rim 37 that projects radially inwards and serves to hold the drive member 17 on the body 2 of the receptacle. The rim 37 bears against a shoulder 38 formed at the bottom end of the wall of the body 2 defining the side of the top compartment 5. The cover 35 bears axially at its free end 39 against the top end of the wall of the body 2 defining the side of the bottom compartment 4. Thus, the drive member 17 is free to rotate on the body 2 about the axis X, while being held axially relative to the body 2.

The device 1 is assembled as follows.

Firstly, the plug 8 is put into place inside the body 2 by being inserted through the opening of the neck 7. Sealing to separate the compartments 4 and 5 is advantageously tested at this stage of manufacture. Thereafter, the bottom compartment is filled with component B via the opening of the neck 6, and then the end part 13 is screwed thereon.

Component A can then be inserted into the top compartment 5 through the opening of the neck 7, and pass into all of the top compartments via the side slots 12 in the drive rod 11. After the top compartment has been filled, the dispenser endpiece 18 is screwed together with the coupling member 20 onto the neck 7 until the annular rim 22 snaps into the groove 21.

After the grooves 33 have been put into register with the top ends of the ribs 32, the drive member 17 can then be lowered over the coupling member 20 and onto the top compartment of the body 2 merely by moving it downwards in translation until the annular rim 37 passes resiliently over the shoulder 38 and the cover 35 has come into abutment against the body 2.

It will be observed that while components A and B are being stored separately, the cap 40 does not emerge sufficiently through the orifice 36 for a user to be able to take hold of it.

It is thus impossible to unscrew the closure cap 40 in order to dispense component A, thereby avoiding any possibility of the user gaining access to unmixed component A.

It is thus possible, in complete safety, to use the device of the invention to package a component that is corrosive or that is an irritant, such as thioglycolic acid.

To use the device, the user turns the drive member 17 driving the coupling member 20 via the ribs 32 which are engaged in the grooves 33.

The thread on the neck 7 and the thread on the coupling member 20 are shaped so that rotating the coupling member 20 causes it to move upwards through a distance which is sufficient to displace the plug 8 from the constriction 3. While the coupling member 20 is moving upwards, the ribs 32 slide in the associated grooves 33 of the drive member 17. The coupling member 20 is accompanied in its axial displacement by the drive rod 11, and after the coupling member 20 has moved upwards through a stroke of sufficient length, the plug 18 releases the constriction 3 and allows component A contained in the top compartment 5 to flow into the bottom compartment 4 to be mixed with component B. It will be observed that displacement of the drive rod 11 and of the dispenser endpiece 18 increases the inside volume of the receptacle, with this being advantageous when mixing of components A and B is accompanied by an increase in the volume thereof, by heat being given off, or by gas being evolved, since this makes it possible to restrict the extra pressure generated in the receptacle when it is opened.

At the end of the rotary stroke of the drive member 17, the coupling member 20 has moved upwards through a distance which is sufficient for the closure cap 40 to become accessible to the user, who can then unscrew it to extract the mixture.

It is advantageous for the distributor endpiece to be opened by means of a screw cap since that makes it possible, where necessary, to release the residual excess pressure inside the receptacle in a progressive manner. Naturally, without going beyond the ambit of the invention, the cap 40 could be replaced by a snap-off tip formed integrally with the endpiece 18. Nevertheless, under such circumstances, it can be difficult to obtain an outlet orifice free from flash that could deflect the jet of substance leaving the orifice.

Figure 5:
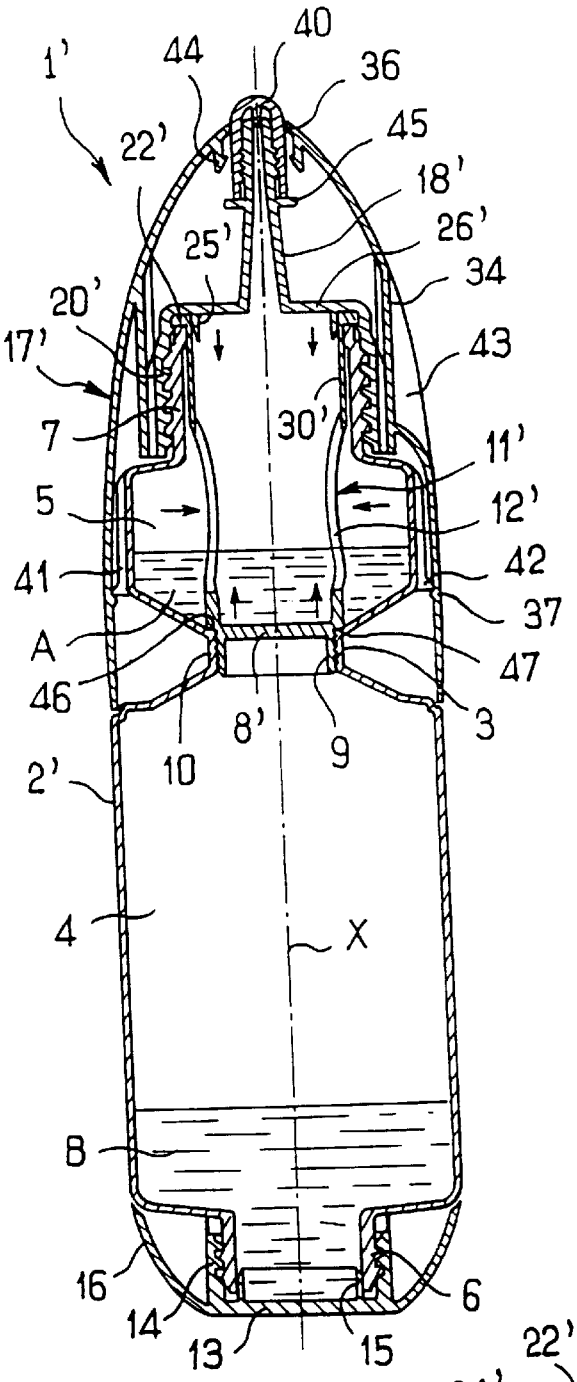
FIG. 5 is a diagrammatic axial section view of a device constituting a second embodiment of the invention.
Figure 7:
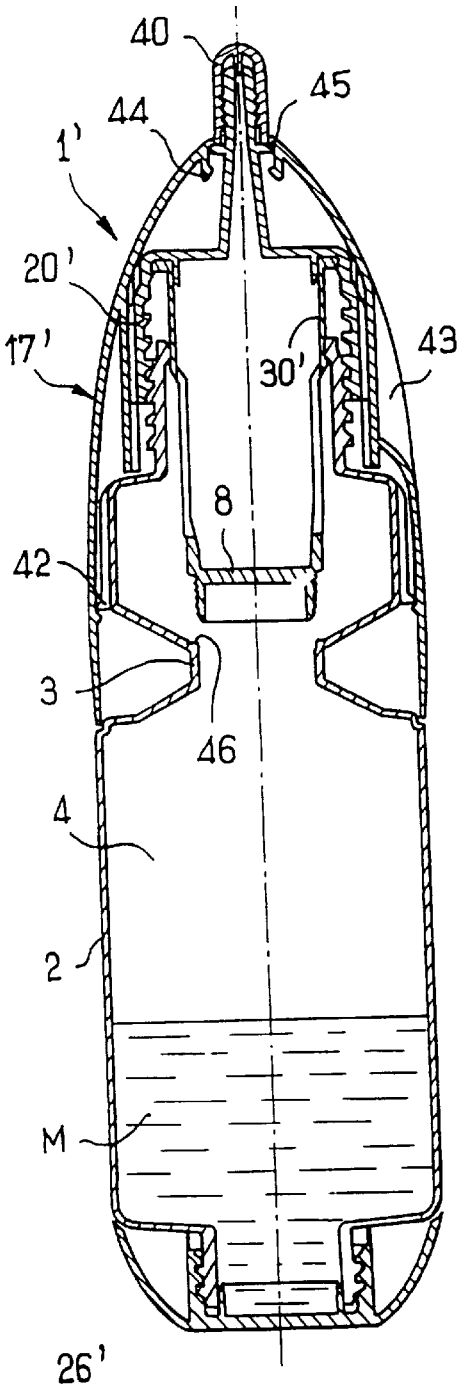
FIG. 7 shows the FIG. 5 device after its components have been mixed together.
Figure 6:
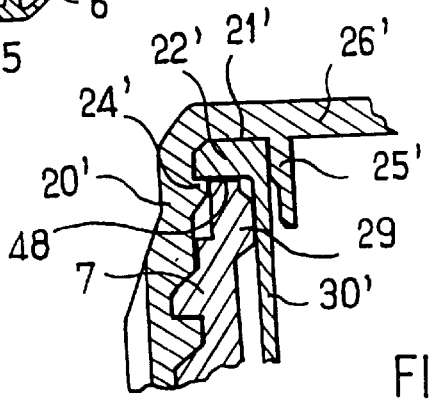
FIG. 6 shows a detail of the FIG. 5 embodiment.

FIGS. 5 to 7 show a device 1' constituting a second embodiment of the invention. This device includes elements that are identical or functionally analogous to those of the preceding embodiment, which elements are given the same reference symbols and are not described in detail again.

The device 1' comprises a receptacle body 2' which differs from the body 2 mainly by the presence of bearing surfaces 41 formed on the radially outer surface of the wall defining the side of the top compartment 5. These bearing surfaces 41 have projections 42 at their bottom ends serving to retain the annular rim 37 of the drive member 17'. This drive member differs from the drive member 17 described above mainly by the presence on the outer surface of the cover 35' of ribs 43 which make it easier for the user to grip and by the presence, in the vicinity of the orifice 36, of tongues 44 which make a snapping sound when a collar 45 formed on the dispenser endpiece 18' goes past them, thereby informing the user that the drive member 17' has been turned far enough.

The tongues 44 preferably have respective teeth at their bottom ends capable of snapping resiliently past the collar 45 as it moves upwards, but preventing the dispenser endpiece 18' from moving back downwards. It is thus impossible, after first use, for the user to return the plug 8 into its initial position.

The collar 45 advantageously has openings (not shown) enabling a drop of substance running over the top end of the endpiece 18' to run into the drive member instead of running over its outside surface. This improves operating comfort.

The plug 8' is secured to a drive rod 11' whose top end has an annular rim 22' which is snapped into a groove 21'. The dispenser endpiece 18' and the coupling member 20' are integrally formed with a transverse wall 26' and together they form the above-mentioned groove 21'. The drive rod 11' has a bottom portion with openings in the form of lateral slots 12', and a circularly cylindrical top portion 30' extending axially from the top ends of the slots 12' to the rim 22'. Unlike the above-described rim 22, the rim 22' has a top face that is plane and substantially perpendicular to the longitudinal axis X, as shown in FIG. 6. This top face bears against the wall 26'. The annular rim 22' is retained in the groove 21' by snap-fastening engagement of a shoulder 24' analogous to the above-described shoulder 24. The wall 26' carries a sealing lip 25' on its bottom face which presses against the radially inner surface of the annular rim 22'.

The top portion 30' of the drive rod 11' does not have an annular groove 31 for receiving the annular rim 29, unlike the above-described embodiment.

The plug 8' is connected to the drive rod 11' by means of a shoulder 46' that comes to rest axially against a shoulder 47 formed by the constriction 3.

Preferably, the length of the drive rod 11' is selected so that it is compressed axially when the plug 8' rests via the shoulder 46 on the shoulder 47, and the annular rim 22' is snapped in the groove 21' and rests against the top end edge 48 of the neck 7.

The drive rod 11' is advantageously shaped so that under the effect of axial compression, its wall level with the lateral slots 12' tends to deform elastically radially inwards. By maintaining a small amount of axial compression in the drive rod 11' during storage, it is possible to further improve sealing of the closure of the compartment 5 during storage.

The device is filled, assembled, and used, in the same way as the above-described device 1.

Figure 8:
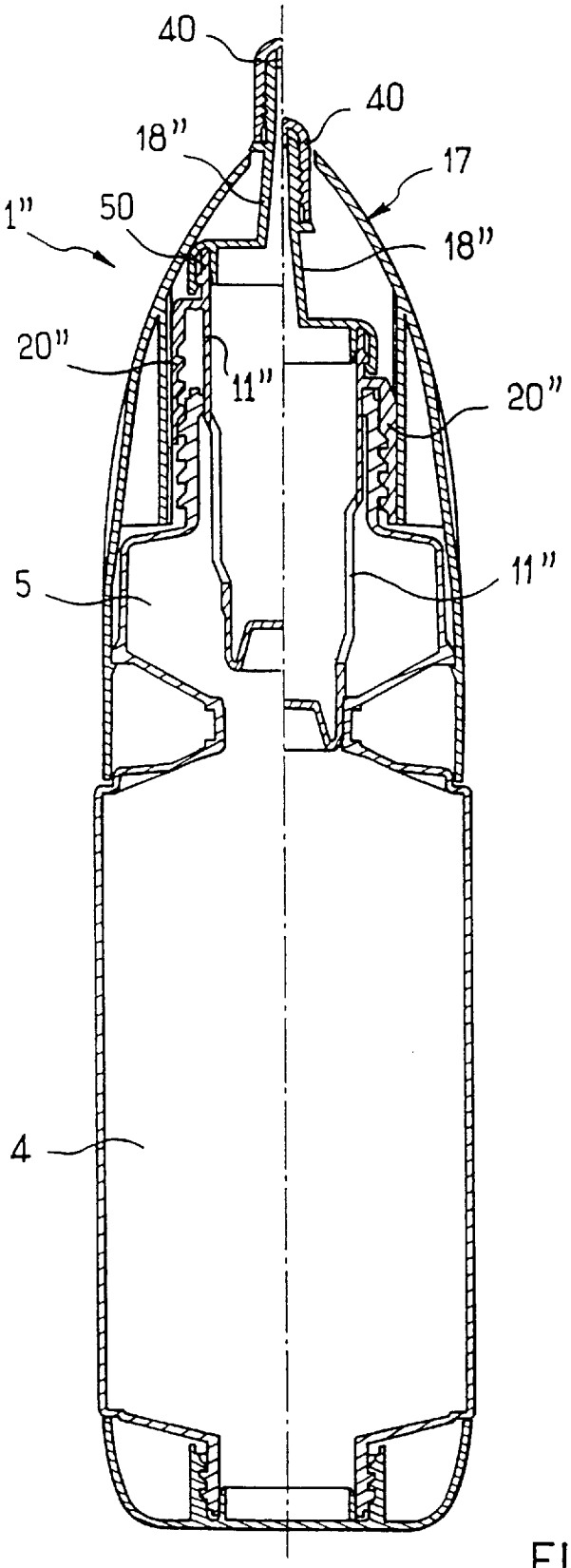
FIG. 8 is a diagrammatic axial section view of a device constituting a third embodiment of the invention.

FIG. 8 shows a device 1" in which the drive rod 11" is integrally molded with the coupling member 20".

The dispenser endpiece 18" is snap-fastened on an annular rib 50 that extends the drive rod 11" upwards.

Naturally, the invention is not limited to the embodiment described above.

In particular, the coupling member can be implemented differently, by replacing the slideway link between the coupling member and the drive member by a screw link and by replacing the screw link between the coupling member and the body of the receptacle by a slideway link.

I claim:

1. A device for separately packaging two components, for mixing them together, and for dispensing the resulting mixture, the device comprising a receptacle having two compartments, a removable plug for separating said compartments prior to first use, a dispenser endpiece defining an outlet channel initially closed by closure means, a rotary drive member suitable, in an initial position, for preventing the closure means being removed, and coupling means for transforming rotation of the drive member into action on the plug for the purpose of putting the two compartments into communication with each other, wherein said coupling means comprise a coupling member that is axially movable at the same time relative both to the two compartments of the receptacle and to the drive member.

2. A device according to claim 1, wherein said coupling means comprise a slideway link between the coupling member and one of the receptacle and the drive member.

3. A device according to claim 1, wherein said coupling member is in the form of a tubular skirt secured to the dispenser endpiece.

4. A device according to claim 3, wherein said tubular skirt co-operates by screw-engagement relative to the receptacle and by slideway link relative to the drive member.

5. A device according to claim 1, wherein said plug is integrally molded with a drive rod secured to said coupling member.

6. A device according to claim 5, wherein said drive rod is secured by snap-fastening to said coupling member, and wherein the dispenser endpiece is integrally molded with the coupling member.

7. A device according to claim 5, wherein the coupling member is integrally molded with the drive rod, and wherein the dispenser endpiece is secured to the drive rod by snap-fastening.

8. A device according to claim 5, wherein, when the drive member is in its initial position, the drive rod is axially compressed, and wherein the drive rod is shaped in such a manner as to be capable of deforming elastically under the effect of such compression.

9. A device according to claim 5, wherein the drive rod is hollow and has a circularly cylindrical top portion.

10. A device according to claim 1, wherein said receptacle comprises a body made as a single piece having two ends and having between these two ends a constriction serving as a seat for said plug prior to the components being mixed together.

11. A device according to claim 10, wherein said receptacle body is made by injection blow-molding.

12. A device according to claim 11, wherein said receptacle body is made by injection blow-molding using PVC.

13. A device according to claim 10, wherein said receptacle body is made by coextrusion blow-molding.

14. A device according to claim 13, wherein said receptacle body is made by molding coextruded PE/EVOH/PE material.

15. A device according to claim 10, wherein said plug has a shoulder shaped to bear axially against the constriction through which the two compartments communicate.

16. A device according to claim 1, wherein said receptacle has two ends and wherein these ends are both open prior to the receptacle being filled.

17. A device according to claim 1, wherein said drive member is externally in the form of a cover having a top and that snap-fastens onto the receptacle, wherein said cover is provided with a unique central aperture at its top through which said dispenser endpiece moves during rotation of the drive member, said closure means extending at least partly inside said drive member in said initial position and said closure means extending outside said drive member after the two compartments have been put into communication by the rotation of said drive member.

18. A device according to claim 17, wherein said cover snap-fastens on a rim formed at the end of the top compartment of the receptacle, adjacent to said constriction.

19. A device according to claim 17, including one portion in relief placed on the dispenser endpiece so that when said portion in relief sasses said aperture it clicks audibly, thereby informing a user that the dispenser endpiece has finished its stroke.

20. A device according to claim 1, wherein said closure means is formed by an internally threaded cap.

* * * * *